US006167215A

United States Patent [19]

Miyashiro et al.

[11] Patent Number: 6,167,215

[45] Date of Patent: Dec. 26, 2000

[54] IMAGE FORMING APPARATUS

[75] Inventors: Toshiaki Miyashiro, Shizuoka-ken; Akihiko Takeuchi, Susono, both of Japan

[73] Assignee: Canon Kabushiki Kaisha, Tokyo, Japan

[21] Appl. No.: 09/426,772

[22] Filed: Oct. 26, 1999

[30] Foreign Application Priority Data

Oct. 28, 1998 [JP] Japan ..... 10-322846

[51] Int. Cl.[7] ..... G03G 15/16

[52] U.S. Cl. ..... 399/66; 399/302; 399/308; 399/343

[58] Field of Search ..... 399/66, 302, 303, 399/308, 310, 313, 314, 343, 344, 345, 353, 354, 357

[56] References Cited

U.S. PATENT DOCUMENTS 5,250,994 10/1993 Ito et al. ..... 355/271

6,049,681 4/2000 Shiozawa et al. ..... 399/66 X

*Primary Examiner*—Arthur T. Grimley
*Assistant Examiner*—Hoan Tran
*Attorney, Agent, or Firm*—Fitzpatrick, Cella, Harper & Scinto

[57] ABSTRACT

An image forming apparatus including an intermediate transfer member, an image forming device for forming a toner image on the intermediate transfer member wherein the toner image on the intermediate transfer member is transferred to a transfer material, a charging member for charging the intermediate transfer member by contacting the intermediate transfer member, wherein discharge is performed between the charging member and the intermediate transfer member by a voltage in which the direct current voltage and the alternating current voltage are superimposed applied to the charging member when the intermediate transfer member is charged by the charging member, and a control device for controlling the voltage applied to the charging member, wherein the control device stops the supply of the alternating current voltage to the charging member after the peak-to-peak voltage applied to the charging member is attenuated.

66 Claims, 13 Drawing Sheets

NON-CHARGE TYPE

IMAGE FORMING APPARATUS

BACKGROUND OF THE INVENTION

1. Field of the Invention

The present invention relates to an image forming apparatus such as a copying machine, a printer, or a facsimile using an electrophotographic process.

2. Related Background Art

FIG. 13 shows one example of a conventional electrophotographic color image forming apparatus. The color image forming apparatus of this example comprises a drum-shaped electrophotographic photosensitive member, which serves as an image bearing member, or in other words a photosensitive drum 3. This photosensitive drum 3 is driven in the direction shown by the arrow by driving means (not shown) and is uniformly charged, for example negatively, by a primary charger 4. Next, a laser beam in accordance with a magenta image pattern from an exposure device 5 is irradiated on the photosensitive drum 3 and an electrostatic latent image is formed on the photosensitive drum 3.

A rotary developing device 6 is placed opposite the photosensitive drum 3. This rotary developing device 6 comprises a rotary supporting member 60 and a plurality of developing units detachably mounted on the rotary supporting member 60. In this example there are four developing units 6*a*, 6*b*, 6*c*, and 6*d*.

When the photosensitive drum 3 with the above electrostatic latent image formed on it rotates in the direction shown by the arrow, the developing unit 6*a* containing magenta toner having a negative polarity among the developing units supported by the rotary supporting member 60 rotates around to be positioned opposite the photosensitive drum 3 so that the electrostatic latent image on the photosensitive drum 3 is visualized developed through so-called reverse development by the selected developing unit 6*a*, or in other words, is made into a toner image.

A second image bearing member 2 is positioned below the photosensitive drum 3. In this example, the second image bearing member is an intermediate transfer belt 2, which serves as an intermediate transfer member, stretched around rollers 21, 23, and 24, and rotated in the direction shown by the arrow at approximately the same speed as the photosensitive drum 3. The toner image formed on the photosensitive drum 3 undergoes a primary transfer onto the outside peripheral surface of the intermediate transfer belt 2 through a primary transfer bias applied to a primary transfer roller 22 at the primary transfer portion (the primary transfer position).

A plurality of color toner images can be superimposed and transferred onto the intermediate transfer belt 2 by performing the above process with cyan, yellow, and black.

Next, a transfer material 11 is fed from inside a transfer material cassette 13 by a pick-up roller 12 with a designated timing. Simultaneously, a secondary transfer bias is applied to a secondary transfer roller 7, which serves as a secondary transfer device, and the toner image is collectively transferred from the intermediate transfer belt 2 to the transfer material 11. The transfer material 11 is conveyed to a fixing device 10 by a conveying belt 9 and a color image is obtained by fusing and fixing the transferred toner image.

Residual toner (residual toner after secondary transfer) on the intermediate transfer belt 2 after completion of secondary transfer is charged, in the present example positively, to the opposite polarity by a charging device 200 such as a contact charger, for example, which serves as an intermediate transfer belt cleaning device. This residual toner after transfer, which has been charged to the opposite polarity, is conveyed to the primary transfer portion again by moving the intermediate transfer belt 2 and counter transferred onto the photosensitive drum 3, which is the counter-electrode, by a primary transfer bias applied to the primary transfer roller 22. The counter transfer toner (residual toner after secondary transfer) and the residual toner after primary transfer on the photosensitive drum 3 are cleaned by a cleaning device 8.

FIG. 14 shows another example of a conventional electrophotographic color image forming apparatus. This color image forming apparatus is called a tandem system or an inline system apparatus and, as opposed to the color image forming apparatus shown in FIG. 13, it has a photosensitive drum 3 for each color (3*a*, 3*b*, 3*c*, and 3*d*) and a developing unit 6*a*, 6*b*, 6*c*, and 6*d* corresponding to each of the drums.

Each photosensitive drum 3*a*, 3*b*, 3*c*, and 3*d* is placed serially on the intermediate transfer belt 2 and uses a method for forming a color image in unison per rotation of the intermediate transfer belt 2. As a result, faster printing is possible.

With this system, it is also possible to clean the intermediate transfer belt with the contact charger 200, which is the above intermediate transfer belt cleaning device. In this case, a cleaning device 8*a* built collateral to the first color photosensitive drum 3*a* collects the residual toner after secondary transfer.

Also, the intermediate transfer belt cleaning device 200 in the tandem system, as opposed to in the one-drum system described above, usually abuts against the intermediate transfer belt 2, which serves as an intermediate transfer member.

The mechanism of intermediate transfer belt cleaning is now described in further detail. The mechanism of intermediate transfer belt cleaning is identical in the image forming apparatus of FIG. 13 and the color image forming apparatus of FIG. 14. Therefore, it will be described in relation to the image forming apparatus of FIG. 13.

When the toner is transferred from the intermediate transfer belt 2 to the transfer material 11, it is subjected to a strong magnetic field of the opposite polarity to the toner and much of the toner remains on the intermediate transfer belt 2, charged to the opposite polarity (in this example, positive) to its regular charging polarity (in this example, negative) as residual toner after second transfer. However, this does not mean that all of the toner is reversed to a positive polarity. Neutralized toner without a charge and toner maintaining its negative polarity also exists.

Thus, a contact charger is installed as the intermediate transfer belt cleaning device 200 immediately after the secondary transfer position and a voltage in which an alternating-current component is superimposed on a direct current component is applied as the intermediate transfer belt cleaning bias. The residual toner after secondary transfer repeats a reciprocating movement due to the alternating-current component and is charged more uniformly to a positive polarity.

The residual toner after secondary transfer, which has been uniformly charged to a positive polarity, is counter-transferred onto the photosensitive drum 3 at the primary transfer nip and collected by the cleaning device 8 on the photosensitive drum 3.

Even during continuous printing, the charge of the oppositely charged residual toner after secondary transfer on the intermediate transfer belt 2 and the regular charge of the toner transferred from the photosensitive drum 3 at primary transfer are not offset by contact of a short term. Accordingly, it is possible to transfer each type of toner at the primary transfer portion: residual toner after secondary transfer is transferred onto the photosensitive drum 3, and regular toner on the photosensitive drum 3 is transferred onto the intermediate transfer belt 2. In this way, residual toner after secondary transfer is not transferred onto the transfer material 11 during the next print and an accurate image is output.

If the above intermediate transfer belt cleaning device 200 is used, a waste toner container for collecting residual toner after transfer on the intermediate transfer belt 2 can be used in conjunction with the cleaning device 8 on the photosensitive drum 3, enabling the device to be made more compact and improving maintainability.

For the intermediate transfer belt 2 used in the above color image forming apparatus, there is a non-charge type comprising a material with a value of volume resistivity of approximately $10^5$ Ωcm to $10^8$ Ωcm, which is itself difficult to charge by toner delivery or by the charge of the primary transfer and secondary transfer biases, and a charge type comprising a material with a value of volume resistivity of approximately $10^9$ Ωcm to $10^{16}$ Ωcm, which is itself easy to charge.

Many constructions of the charge type intermediate transfer belt 2 have been designed. For example, a belt has been designed as shown in FIGS. 7 and 8 in which the intermediate transfer belt 2 has two-ply or three-ply construction, wherein the value of volume resistivity of the surface layer 2A of the belt in FIG. 7 and the intermediate layer 2B of the belt in FIG. 8 (approximately 5 to 50 μm thick) is approximately $10^{10}$ Ωcm to $10^{16}$ Ωcm, the base layer 2C is of a material with a value of volume resistivity of $10^3$ Ωcm to $10^8$ Ωcm, and the belt as a whole is $10^9$ Ωcm to $10^{16}$ Ωcm.

FIG. 9 and FIG. 10 show the state of the toner on the above intermediate transfer belts 2. As shown in FIG. 10, when a charge type structure is used as the intermediate transfer belt, as compared to the use of a non-charge type as shown in FIG. 9, scattering of the toner, which becomes a problem when layering colors on the intermediate transfer belt 2, can be reduced because the absolute value of the electric potential of the superimposed toner image is lower than that of the non-image portion, and image quality is improved.

No matter which type of intermediate transfer belt 2 above is used, the above-described intermediate transfer belt cleaning can be performed. However, when a charge type intermediate transfer belt is used, it is also possible to eliminate the excess charge on the intermediate transfer belt 2 with the intermediate transfer belt cleaning device 1.

For the intermediate transfer belt cleaning bias including such an elimination ability, a rectangular waveform with high charging capability and a large high-frequency component is used as the AC bias and a deflected waveform such as that shown in FIG. 11 is used in order to coexist with the charging polarity of the residual toner after secondary transfer. The convergent electric potential when such waveforms are used is not the integrated average value of the waveforms, but the electric potential in the exact middle between Vmax and Vmin, or Vmin+(Vmax−Vmin)/2.

To give one example of an intermediate transfer belt cleaning bias, if an alternating current bias wherein the frequency is 3 kHz, the alternating current component is (Vp-p)=2.4 kVpp, the +Duty is 80%, and the direct current component is (Vdc)=+720 V to 920 V is applied, the charging electric potential is between 0 V and +200 V.

As mentioned above, the intermediate transfer belt cleaning device for a charge type intermediate transfer belt fills two roles: unifying the polarity of the residual toner after secondary transfer to a positive polarity (the opposite polarity of the regular charging polarity) and to initialize the surface electric potential of the intermediate transfer belt charged positively by the secondary transfer bias. Accordingly, the intermediate transfer belt cleaning device must both fulfill the uniform charging of the toner and the uniform charging of the belt surface.

However, when the bias applied to the above intermediate transfer belt cleaning device is turned off, a non-uniform charging state due to the reasons explained below exists and an uneven charge is generated on the intermediate transfer belt.

An uneven charge on the intermediate transfer belt will cause unevenness in the primary transfer of the image to follow as well. In particular, a uniform half-tone image will have blank areas due to a decrease in transfer efficiency or will deviate from the optimum transfer electric field range and the half-tone image will scatter with an uneven density degrading the quality of the image markedly. These inconveniences result when the intermediate transfer belt cleaning device is a low-cost contact charger that generates a low amount of ozone, such as a roller charger for example.

The mechanism causing an uneven charge on the intermediate transfer belt originates in the method of discharge within the discharge range of the contact charger when the cleaning bias is turned off. In order for the cleaning bias to charge the intermediate transfer belt after secondary transfer uniformly, it is necessary to eliminate for one full revolution from the starting point of the intermediate transfer belt, but by discharging after this elimination is complete, an uneven electric potential results as described below.

FIGS. 12A to 12C show the waveform when the cleaning bias supplied to the intermediate transfer belt cleaning device is turned off and the type of uneven electric potential that results on the intermediate transfer belt thereafter.

As can be understood from the Figures, when the cleaning bias is turned off, the electric potential of the intermediate transfer belt at that time is determined in accordance with the position at which the AC bias applied to the roller charger is cut off, or in other words, according to where the last electric potential was. If the difference in electric potential between this last electric potential and the surface electric potential of the intermediate transfer belt within the discharge nip is higher than the voltage at commencement of discharge, a final discharge is performed and the electric potential becomes the last electric potential minus the voltage at commencement of discharge (approximately 500 V). Accordingly, it is worst to turn off the bias at the apex of the AC bias and when using a rectangular wave the above problem is striking.

In order to solve this problem, there are methods in which the cleaning bias is turned off on the non-image portion on the intermediate transfer belt, but because the non-image portion will not necessarily be on the photosensitive drum corresponding to the non-image portion, an uneven electric potential on the intermediate transfer belt will be traced on the photosensitive drum at a primary transfer portion as a transfer memory, the uneven electric potential on the photosensitive drum can not be erased during primary charging, and will appear again on the image as a primary charging malfunction.

SUMMARY OF THE INVENTION

It is an object of the present invention to provide an image forming apparatus that can prevent the creation of an uneven charge on the intermediate transfer member after the intermediate transfer member has been charged by charging means.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Following is a detailed description with reference to the Figures of the image forming apparatus of the present invention.

[Embodiment 1]

Figure 6:
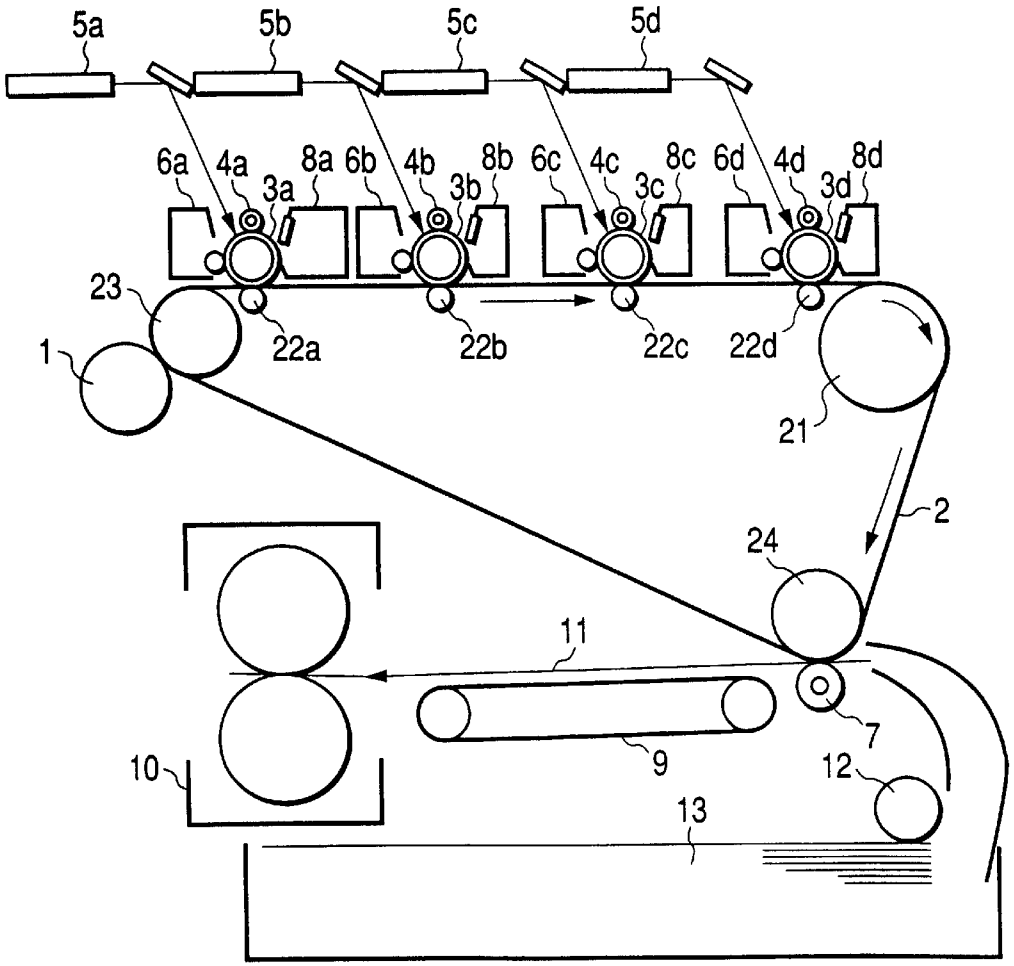
FIG. 6 is a schematic structural diagram of another embodiment of a color image forming apparatus in which the present invention can be applied.
Figure 7:
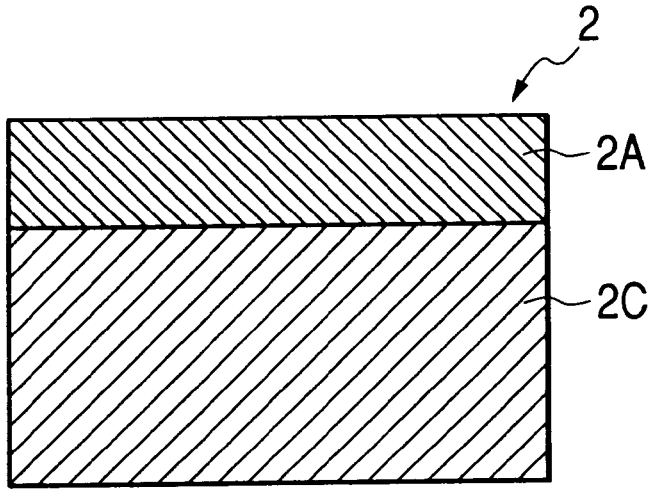
FIG. 7 shows the construction of one embodiment of the intermediate transfer belt.
Figure 8:
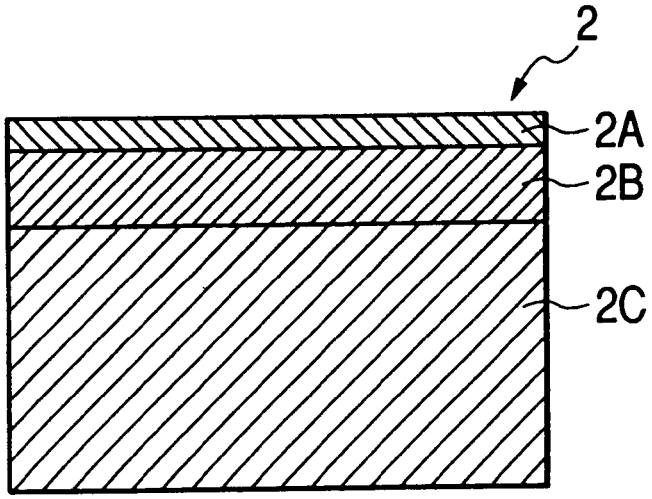
FIG. 8 shows the construction of another embodiment of the intermediate transfer belt.
Figure 9:
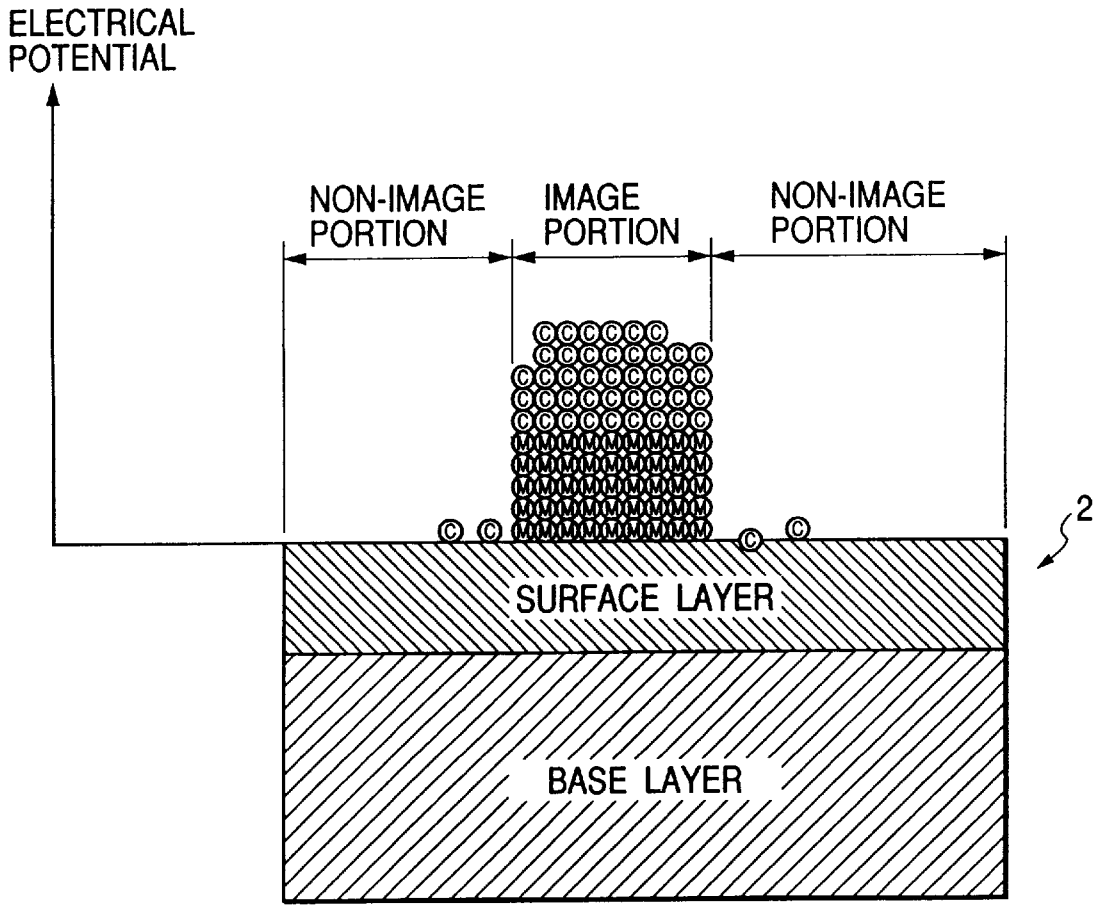
FIG. 9 is a conceptual diagram showing the state of the toner on a non-charge type intermediate transfer belt.
Figure 10:
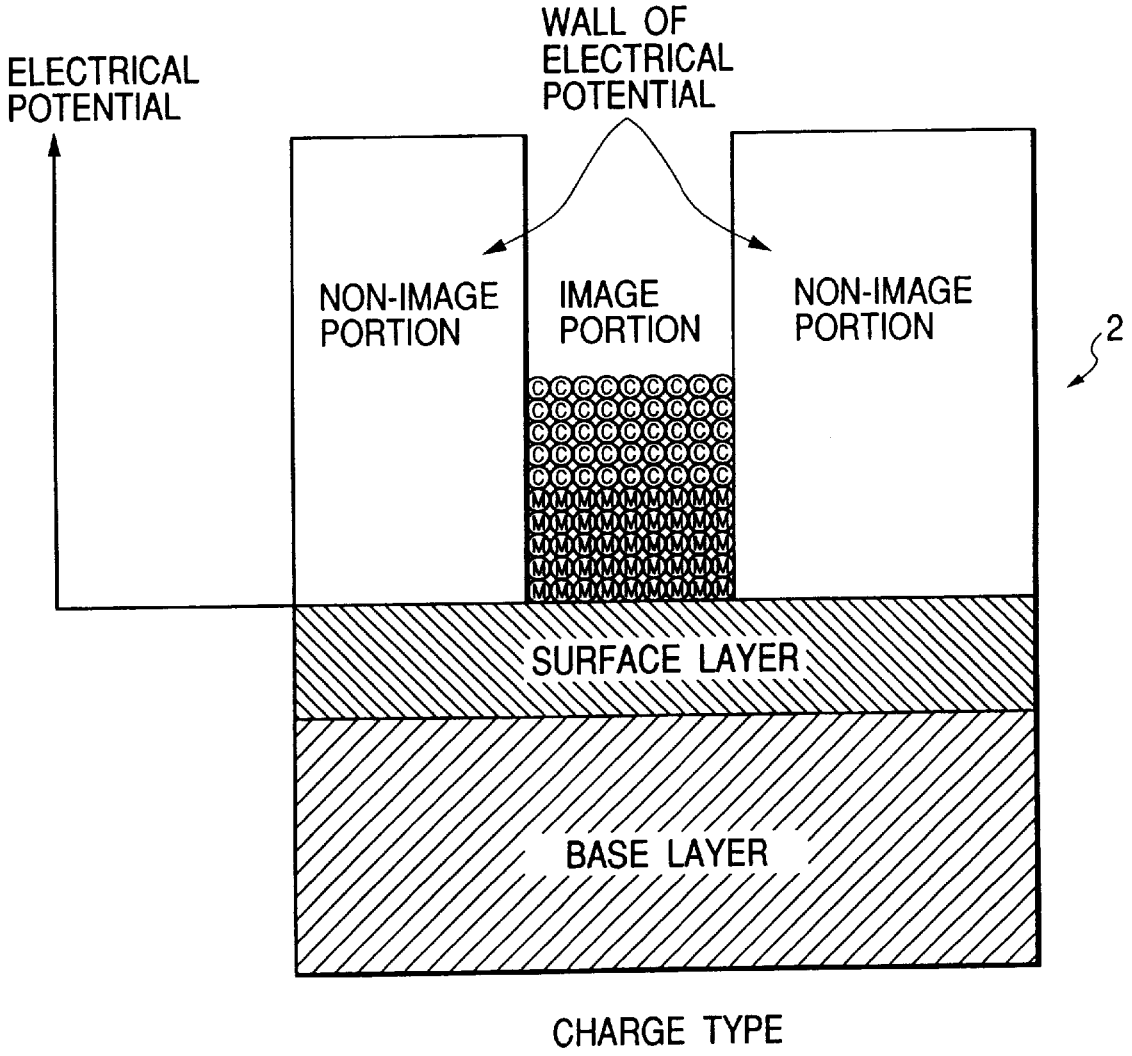
FIG. 10 is a conceptual diagram showing the state of the toner on a charge type intermediate transfer belt.
Figure 11:
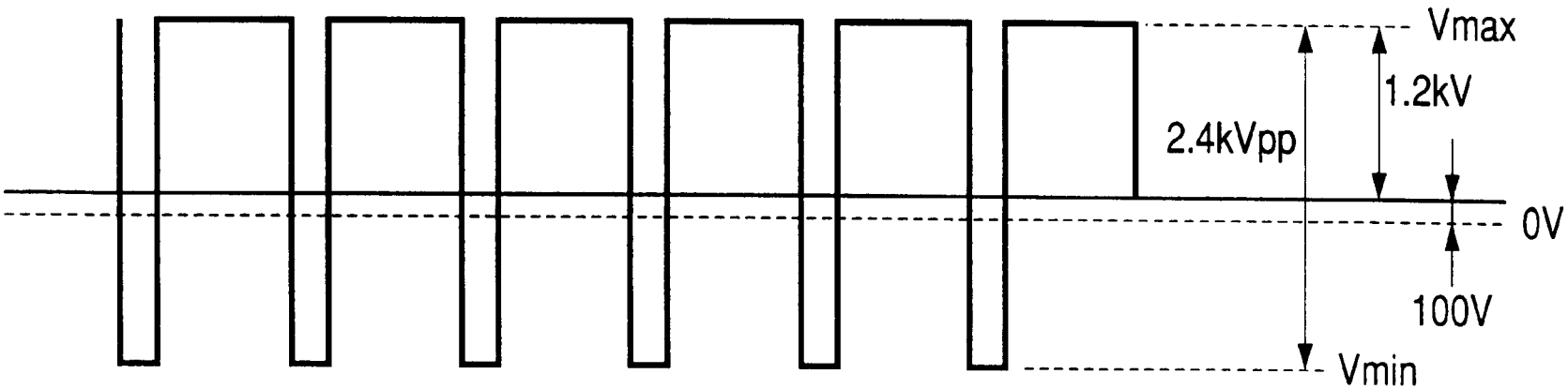
FIG. 11 shows one example of the cleaning bias.
Figures 12A, 12B, 12C:
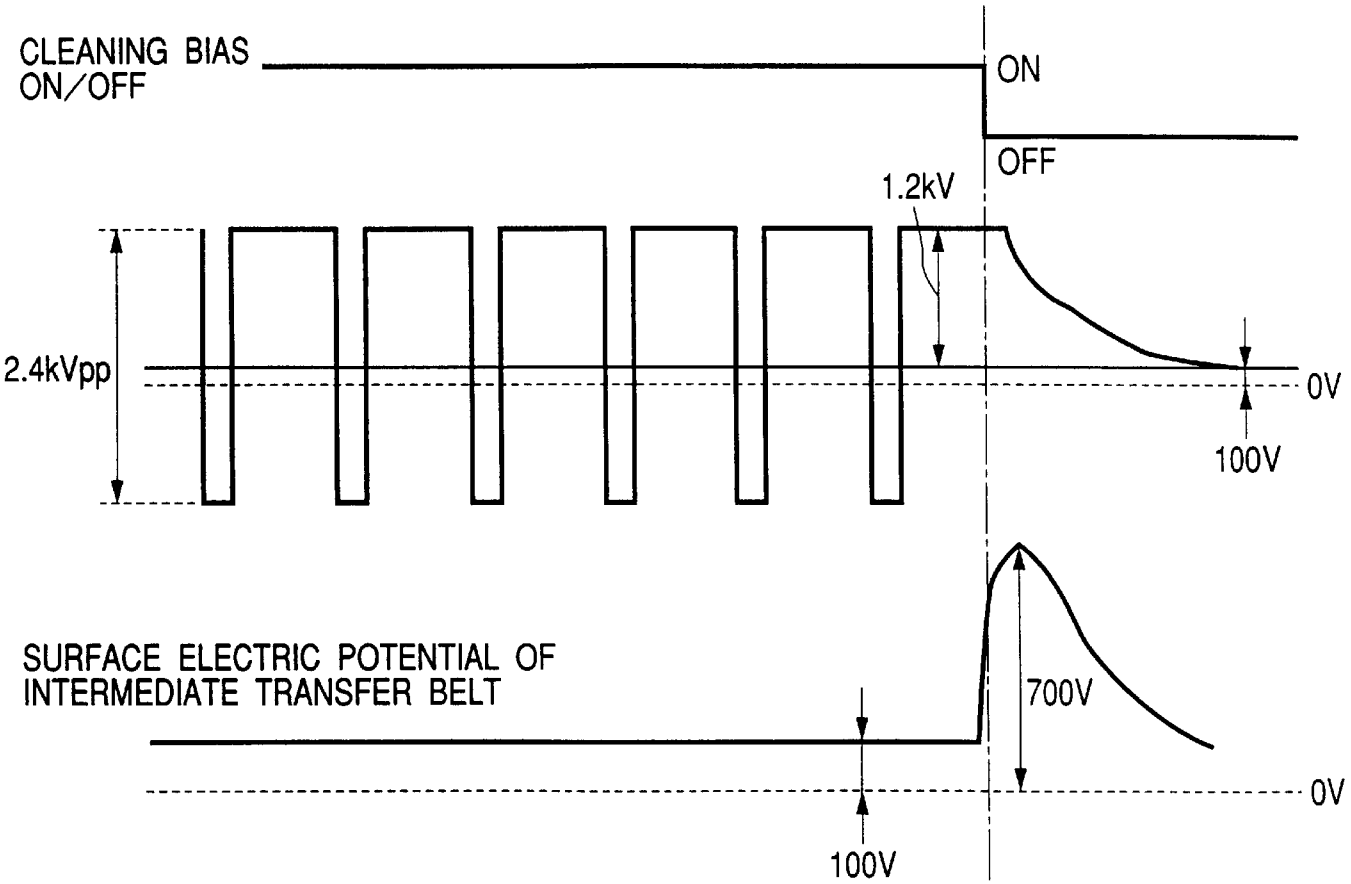
FIGS. 12A, 12B, and 12C show the waveform when a conventional cleaning bias is shut off and the surface electric potential of the intermediate transfer belt at that time.
Figure 13:
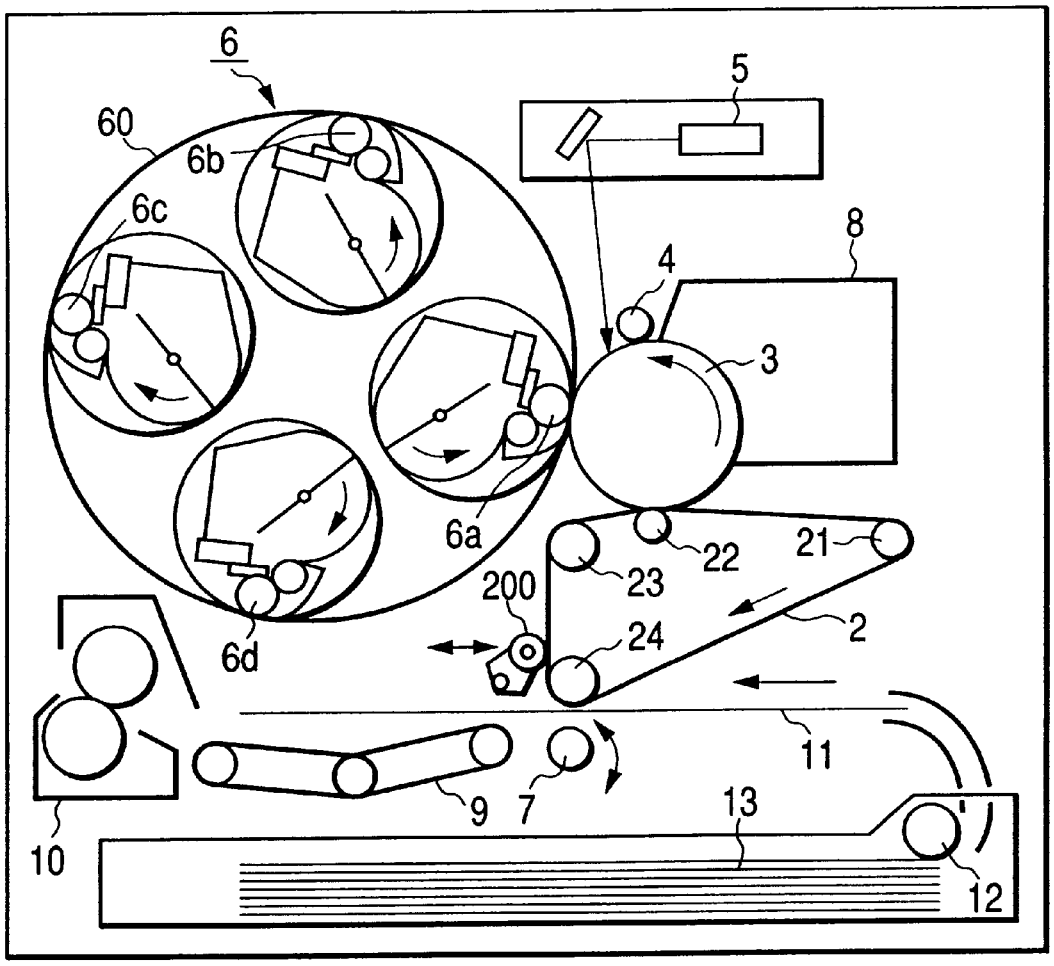
FIG. 13 is a schematic structural diagram of a conventional image forming apparatus.
Figure 14:
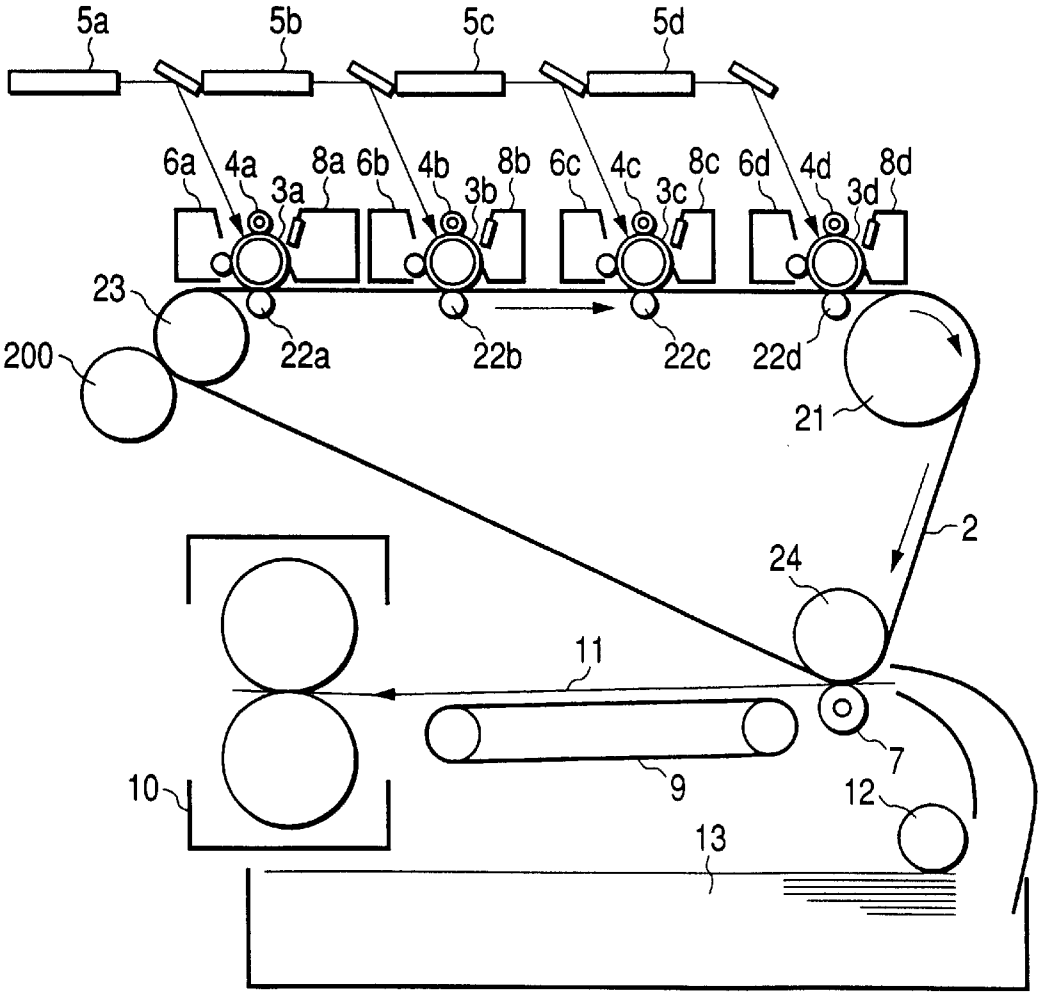
FIG. 14 is a schematic structural diagram of a conventional image forming apparatus.

The present invention will now be explained using the tandem-type color image forming apparatus shown in FIG. 6.

The image forming apparatus of the present invention comprises four image bearing members 3*a*, 3*b*, 3*c*, and 3*d* for forming a toner image for which the regular charging polarity is negative in each of four colors: yellow, magenta, cyan, and black. The image bearing members 3*a*, 3*b*, 3*c*, and 3*d* in the present embodiment are drum-shaped electrophotographic photosensitive members, or so-called photosensitive drums, and are arranged serially. Primary chargers 4*a*, 4*b*, 4*c*, and 4*d*, developing units 6*a*, 6*b*, 6*c*, and 6*d*, and cleaning devices 8*a*, 8*b*, 8*c*, and 8*d* corresponding to each photosensitive drum are placed around the periphery of each of the photosensitive drums 3*a*, 3*b*, 3*c*, and 3*d* and exposure devices 5*a*, 5*b*, 5*c*, and 5*d* are placed above each of the photosensitive drums 3*a*, 3*b*, 3*c*, and 3*d*.

Each photosensitive drum 3*a*, 3*b*, 3*c*, and 3*d* is negatively charged by charging rollers 4*a*, 4*b*, 4*c*, and 4*d* which contact them respectively and exposed by exposure devices 5*a*, 5*b*, 5*c*, and 5*d* with a color separated light image in each of the colors: yellow, magenta, cyan, and black. Latent images in yellow, magenta, cyan, and black are formed on the photosensitive drums 3*a*, 3*b*, 3*c*, and 3*d*, the respective latent images are developed by developing units 6*a*, 6*b*, 6*c*, and 6*d* by reverse development, and toner images of yellow, magenta, cyan, and black are sequentially formed on the photosensitive drums 3*a*, 3*b*, 3*c*, and 3*d*.

An intermediate transfer belt 2 as an intermediate transfer member (image bearing member) is positioned below the photosensitive drums 3*a*, 3*b*, 3*c*, and 3*d*. The intermediate transfer belt 2 is stretched around rollers 21, 23, and 24 and is rotated at approximately the same speed as the photosensitive drums 3*a*, 3*b*, 3*c*, and 3*d* in the direction shown by the arrow. The toner images formed on the photosensitive drums 3*a*, 3*b*, 3*c*, and 3*d* are transferred with an electrostatic primary transfer to the outside peripheral surface of the intermediate transfer belt 2 by a primary transfer bias (a positive voltage) applied to the primary transfer rollers 22*a*, 22*b*, 22*c*, and 22*d* at the primary transfer portion, and a multi-color toner image is formed on the intermediate transfer belt 2 in this way.

Next, a transfer material 11 is fed by a pick-up roller 12 from inside a transfer material cassette 13 with a designated timing. Simultaneously, a secondary transfer bias (a positive voltage) is applied to a secondary transfer roller 7 serving as the secondary transfer device and a toner image is electrostatically transferred from the intermediate transfer belt 2 onto the transfer material 11. The transfer material 11 is conveyed to a fixing device 10 by a conveying belt 9 and the transferred toner image is fused and fixed so that a color image is obtained.

The residual toner after transfer (residual toner after secondary transfer) on the intermediate transfer belt 2 after completion of secondary transfer is charged to the opposite polarity of its regular charging polarity by a contact charger 1, which is the intermediate transfer belt cleaning device (charging means). The residual toner after transfer that has been charged to the opposite polarity is conveyed back to the primary transfer portion by the movement of the intermediate transfer belt 2 and is counter transferred onto the photosensitive drum 3*a*, which is the counter-electrode, by a positive primary transfer bias (a voltage of the opposite polarity of the regular polarity of the toner) applied to the primary transfer roller 22*a*. In this case, the cleaning device 8*a* installed collateral to the first color photosensitive drum 3*a* collects the residual toner after secondary transfer.

Further, the intermediate transfer belt cleaning device 1, or in other words the charging roller serving as the charging means, usually abuts against the intermediate transfer belt 2.

Figure 1:
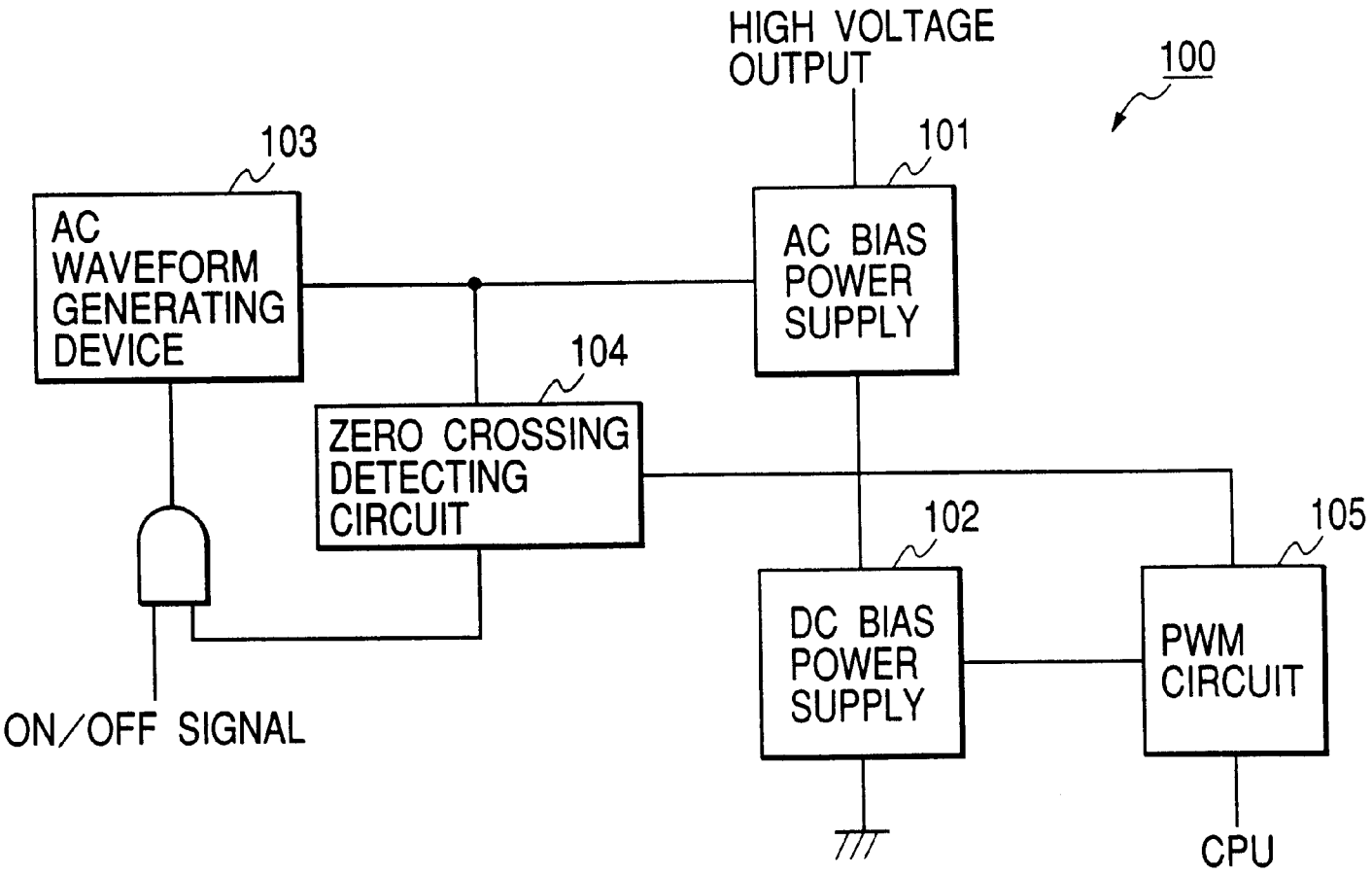
FIG. 1 is a block diagram of the cleaning bias power supply that is the high voltage generating means used in the present invention.

FIG. 1 is a block diagram of another embodiment of a cleaning bias power supply 100. This embodiment is constructed such that the AC and DC output values of the AC and DC bias power supplies 101 and 102 of the cleaning bias power supply 100 can be controlled. As the method of control, a PWM circuit 105 is connected to a zero crossing detecting circuit 104 and the DC bias power supply 102 and the output voltages Vp-p (AC output value (peak-to-peak voltage)) and Vdc (DC output value) are controlled by a PWM signal from the CPU that controls the entire apparatus.

The zero crossing detecting circuit 104 used in the present embodiment does not set the integrated average value at 0, rather it is a circuit that operates when the difference in electric potential of the output electric potential and a designated electric potential becomes 0.

To describe in further detail, if a cleaning bias is produced having a designated duty ratio by the cleaning bias power supply 100 as shown in FIG. 1, a waveform such that the integrated average value becomes 0 is emitted from the AC waveform generating device 103 and adjusted by superimposing the output value of the DC bias power supply 102, adding changes in the waveform as well, to reach the target electric potential (central electric potential). In the present embodiment, because the AC bias should be cut off at the central electric potential, a circuit is used that operates at a difference in electric potential from a designated voltage using a comparator circuit rather than the zero crossing detecting circuit 104 that shuts it off at the integrated average value of the AC waveform. Ideally, with a rectangular waveform a signal will not be obtained in this circuit, but because there is a slight through-rate during actual alternation of a rectangular waveform, (in other words, actually, when the waveform heads from peak to peak it does not go up and down perpendicularly, but rather there is a slight incline) a signal can be obtained if a high-speed switching element is used.

Figures 2A, 2B, 2C, 2D:
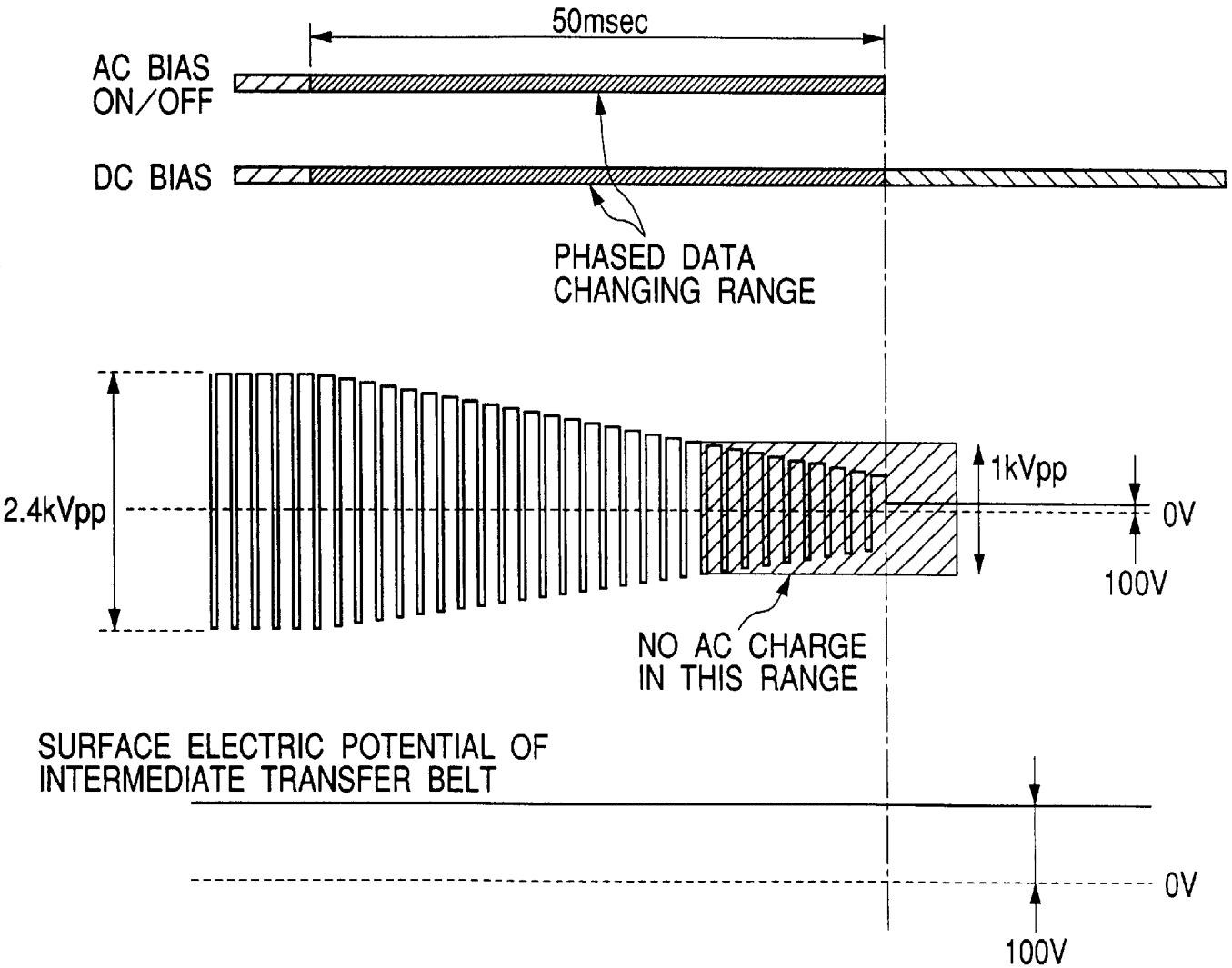
FIGS. 2A, 2B, 2C, and 2D show the sequence and waveform when the cleaning bias in the present invention is shut off as well as the surface electric potential of the intermediate transfer belt before and after the cleaning bias is shut off.

FIGS. 2A to 2D show the cleaning bias shut off sequence of the present embodiment. In the present embodiment as shown in FIGS. 2A to 2D, the PWM signal from the CPU from several tens of msec (milliseconds) before turning the bias off changes the data such that the output voltages Vp-p and Vdc from the AC and DC bias power supplies 101 and 102 are slowly squeezed as shown in FIGS. 2A and 2B.

FIG. 2C is a schematic drawing of the waveform directly before turning the cleaning bias off when using such a bias control.

FIG. 2D is the surface electric potential before and after turning the cleaning bias off on the intermediate transfer belt 2 of the present embodiment.

As can be understood from FIGS. 2A to 2D, the present embodiment is constructed such that the Vdc and Vp-p output of the AC bias of the cleaning bias power supply 100 are phased down and the central value of the AC bias waveform does not change while the Vp-p is reduced.

By attenuating the Vp-p, the range for discharging also becomes gradually smaller in gaps upstream and downstream of the contact position between the charging roller and the intermediate transfer belt. When the difference in the electric potential of both becomes smaller than the electric potential at commencement of discharge, the discharge range disappears. When the cleaning bias (AC voltage) is off, the intermediate transfer belt will not be abnormally charged.

As a result, as shown in FIG. 2D, the surface electric potential of the intermediate transfer belt 2 converges without unevenness at the DC output value, which is the target electric potential. The target electric potential may also be zero.

In the present embodiment, by controlling the AC bias waveform with the CPU, it is attenuated to the central electric potential, but a self-attenuating bias power supply circuit can also be used if the waveform converges on the central electric potential while always maintaining an electric potential approximately symmetrical to the central electric potential.

As the electricity of the intermediate transfer belt 2 within the discharge range (charging range nip) when the AC bias is turned off has already been eliminated to be brought into the central electric potential of the cleaning bias one revolution previous, the Vp-p of the AC bias does not discharge less than approximately 1 kVpp (approximately twice the voltage at commencement of discharge). Therefore, the variation of the AC and DC biases can also be attenuated until the Vp-p is 1 kVpp such that the central electric potential is not changed.

The present inventors modified the data from a state in which an alternating bias of a frequency of 3 kHz, Vp-p=2.4 kVpp, +duty ratio 80%, and Vdc=+820 v is output as the cleaning bias to a state in which Vp-p=0 Vpp and Vdc=+100 V.

In the present embodiment, the output values of the AC bias and the DC bias may be varied even if a high-speed switching element is not used. In this case this means the apparatus can be constructed with a low-cost, high-voltage power supply.

In the present embodiment, because a rectangular waveform was used for which the duty ratio was not 50%, after the AC bias was turned off the DC bias value also was changed. However, if a waveform with a duty ratio of 50% is used, it is clear that would not be necessary.

In the present embodiment, if the residual toner on the intermediate transfer member is charged to a designated polarity (positive in the present embodiment (the opposite polarity to the charging polarity of the toner)), the duty ratio can be found by t/T X100(%) where t is the time that the waveform approaches closer to the designated polarity than to the effective current of the waveform within one period and T is the time for one period of the waveform.

[Embodiment 2]

In the embodiment 1, the present invention was explained given a tandem type color image forming apparatus, but it can also be similarly applied to a one-drum type color image forming apparatus.

If the present invention is applied to a one-drum type color image forming apparatus, the contact charger 1, or in other words a charging roller serving as the charging means, must be separated from the intermediate transfer belt 2 in order to form a full-color image of four colors. In other words, the contact charger 1 must be separated during image formation at least while the toner image is passing through. During the time the charger is separated from the belt the following problems arise.

As explained in the conventional examples, much of the residual toner after secondary transfer is inverted to the opposite polarity (positive, in the present embodiment) from the regular polarity of the toner, but there is also some toner of regular polarity (negative, in the present embodiment) mixed in. Thus, most of the toner of regular polarity is charged to the opposite polarity, in the present invention positively, by the cleaning bias, but a portion of the regular polarity toner adheres to the surface of the charging roller, which is the intermediate transfer cleaning device 1. This adhering toner forms a thin layer on the roller surface maintaining its regular polarity. Thus, while the DC bias is applied to the roller, the toner with its regular polarity on the surface of the roller adheres to the surface of the roller.

However, when the charging roller 1 and the intermediate transfer belt 2 are separated and the DC bias is turned off, the toner of regular polarity that forms a thin layer on the surface of the charging roller 1 is transferred to the intermediate transfer belt 2 and the so-called phenomenon of "toner vomit" occurs.

Because more or less of the surface electric potentials of the surface of the charging roller 1 and the surface of the intermediate transfer belt 2 are inverted, the toner with regular polarity adhering to the surface of the roller is electrically moved. This toner vomit toner will then appear on the following image when continuously forming images on successive transfer materials because the toner vomit toner is of a polarity that will not be counter transferred from the intermediate transfer belt to the photosensitive drum at the primary transfer portion.

In the present invention these problems have been solved by timing the separation of the intermediate transfer member cleaning device 1 for the time when the average electric potential on the surface of the charging roller during attenuation after the AC bias is turned off rises above the electric potential of the surface of the intermediate transfer belt and for when the difference in electric potentials dips lower than the voltage at commencement of discharge. Following is a detailed description.

Figures 3A, 3B, 3C, 3D:
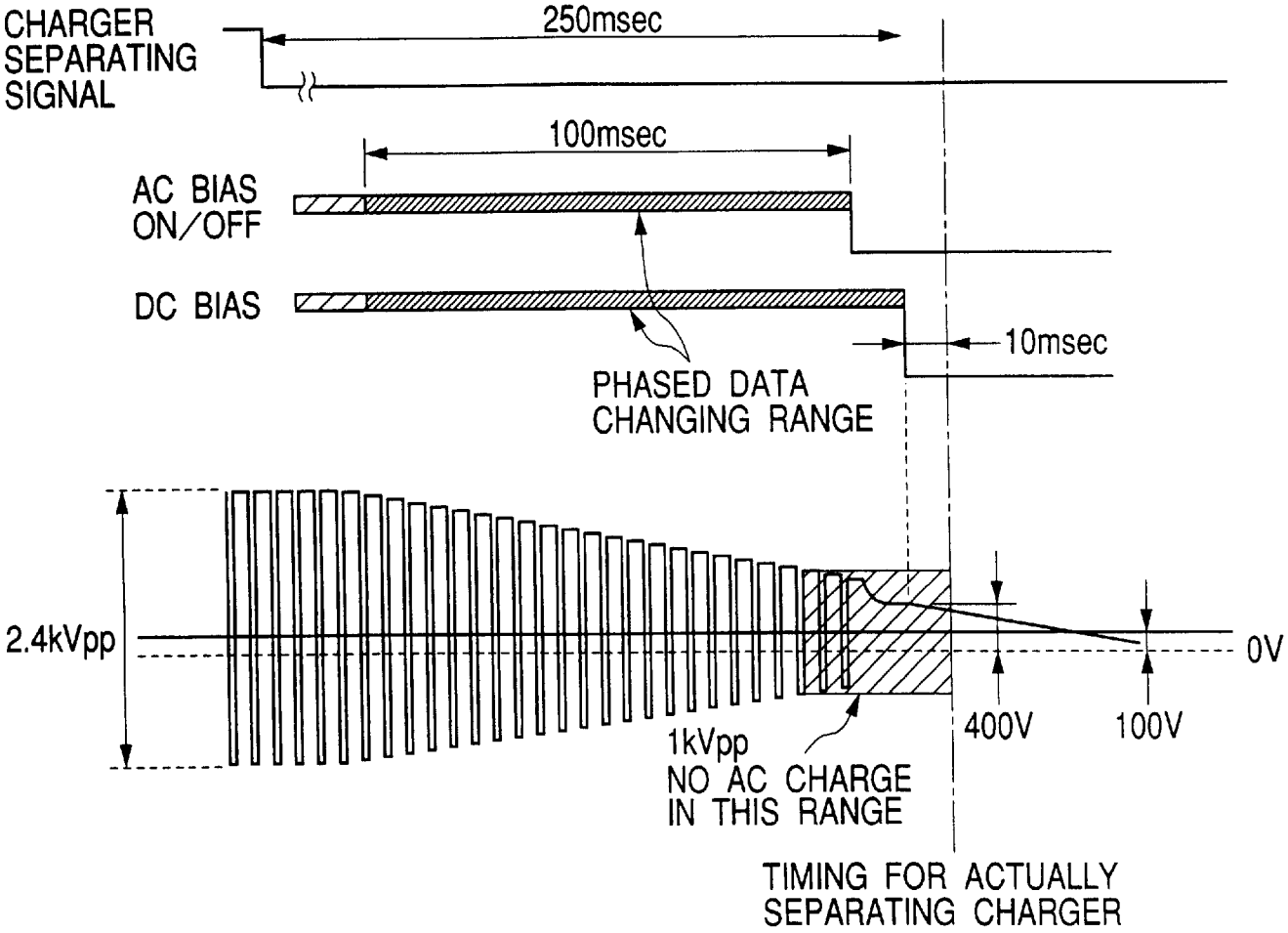
FIGS. 3A, 3B, 3C, and 3D show the sequence and waveform when another cleaning bias used in the present invention is shut off as well as the surface electric potential of the intermediate transfer belt before and after the cleaning bias is shut off.

FIGS. 3A, 3B, and 3C show a timing chart of the intermediate transfer belt cleaning device 1 of the present invention. FIG. 3D shows a schematic view of the bias waveform at that time.

In FIG. 3A, the timing for separating the intermediate transfer belt cleaning device 1 from the intermediate transfer belt 2, which is its counter-electrode, is approximately 250 msec after a separation signal is emitted from the CPU. This delay is the necessary time for such operations as connecting an electromagnetic clutch or rotating the eccentric cam to its effective position in situations such as when using an electromagnetic clutch/eccentric cam assembly for separating and attaching the intermediate transfer belt cleaning device 1. Accordingly, after approximately 250 msec from actually receiving the signal for separation, it is decided what kind of electric potential the intermediate transfer belt cleaning device 1 has, and whether or not there is abnormal discharge or toner vomit.

In the present invention, the AC and DC bias of the cleaning bias is controlled even before the timing for actual separation, the respective data is altered such that the bias waveform meets the conditions below, the bias is shut off under the conditions below, and actual separation is timed for almost the same time.

1. The AC bias waveform Vp-p is less than 1 kVpp.

2. The integrated average value of the attenuated waveform is higher than the surface electric potential of the intermediate transfer belt and is of the same polarity, and the difference between these electric potentials is less than 500 V.

When the above conditions are met, problems with discharge and toner do not occur between the intermediate transfer belt 2 and the charger 1. Therefore, the above problems can be avoided if the charger 1 is separated from the intermediate transfer belt 2 when the bias waveform is attenuated to these conditions. Further, because the bias power supply 100 is turned off at separation and an active bias is not being applied, even if there is a load fluctuation at separation an abnormal discharge such as to greatly change the surface potential will not result.

The above changes to the AC and DC bias will now be described in further detail. The data of the cleaning bias shown in the conventional example outputting a frequency of 3 kHz, Vp-p=2.4 kVpp, +duty 80%, and Vdc=+820 v is changed to Vp-p=1.0 kVpp and Vdc=+400 v. Under these conditions the AC discharge stops when Vp-p is equal to or less than 1 kvpp, but the average electric potential of the charger 1 becomes the integrated average value of the AC waveform. As a result, though there is no discharge between the charger 1 and the surface of the intermediate transfer belt 2, there is an electric potential difference (in this case, 300 v). Because the cleaning bias must be applied to at least one cycle of the intermediate transfer belt, the cleaning bias has already been applied to the surface of the intermediate transfer belt corresponding to the time the cleaning bias was turned off, and it is charged to approximately +100 V. Therefore, the toner on the intermediate transfer belt cleaning device 1 is picked up by the side of the charger.

Using a waveform such as in the present embodiment, under the conditions for charging the surface to +100 v, the AC bias is +400 V even when Vp-p=1.0 kVpp and there is no abnormal discharge. Accordingly, if the AC and DC bias are turned off under these conditions, and the charger 1 is separated during attenuation, the electric potential of the surface of the charger 1 will be higher than approximately +100 v. Of course, the time constant of at least the DC bias power supply 102 from among the AC and DC bias power supplies 101 and 102 used in the present embodiment will be greater than the retractive speed of the charger 1. Because approximately 50 msec are necessary to attenuate the DC bias power supply 102 used in the present embodiment from +400 V to +100 V, it is turned off approximately 10 msec before the charger 1 is actually separated. This 10 msec is necessary so that at the time of separation a DC bias is not actively applied due to an error when connecting the clutch.

The above explanation applies to a situation in which the AC bias and DC bias power supplies 101 and 102 can be changed by data and can be compulsorily controlled in order to fulfill the above two conditions. However, it is also possible to set the internal impedance within each bias power supply circuit appropriately to bring about attenuation state after the biases are turned off that fulfill the above two conditions.

Each of the embodiments above have been explained using the intermediate transfer belt 2 as an example of the image bearing member (intermediate transfer member) and the intermediate transfer belt cleaning device 1 as an example of the charging member. However, as seen in Embodiment 3 following, the same effects can be obtained if the photosensitive drum 3 or drums 3*a* to 3*d* are used as the image bearing member and the charging roller 4 or rollers 4*a* to 4*d* are used as the charging means.

Further, the intermediate transfer member has been described as an endless belt, but it is not limited to such a form, and it is of course also possible to use a drum shape.

[Embodiment 3]

Figure 4:
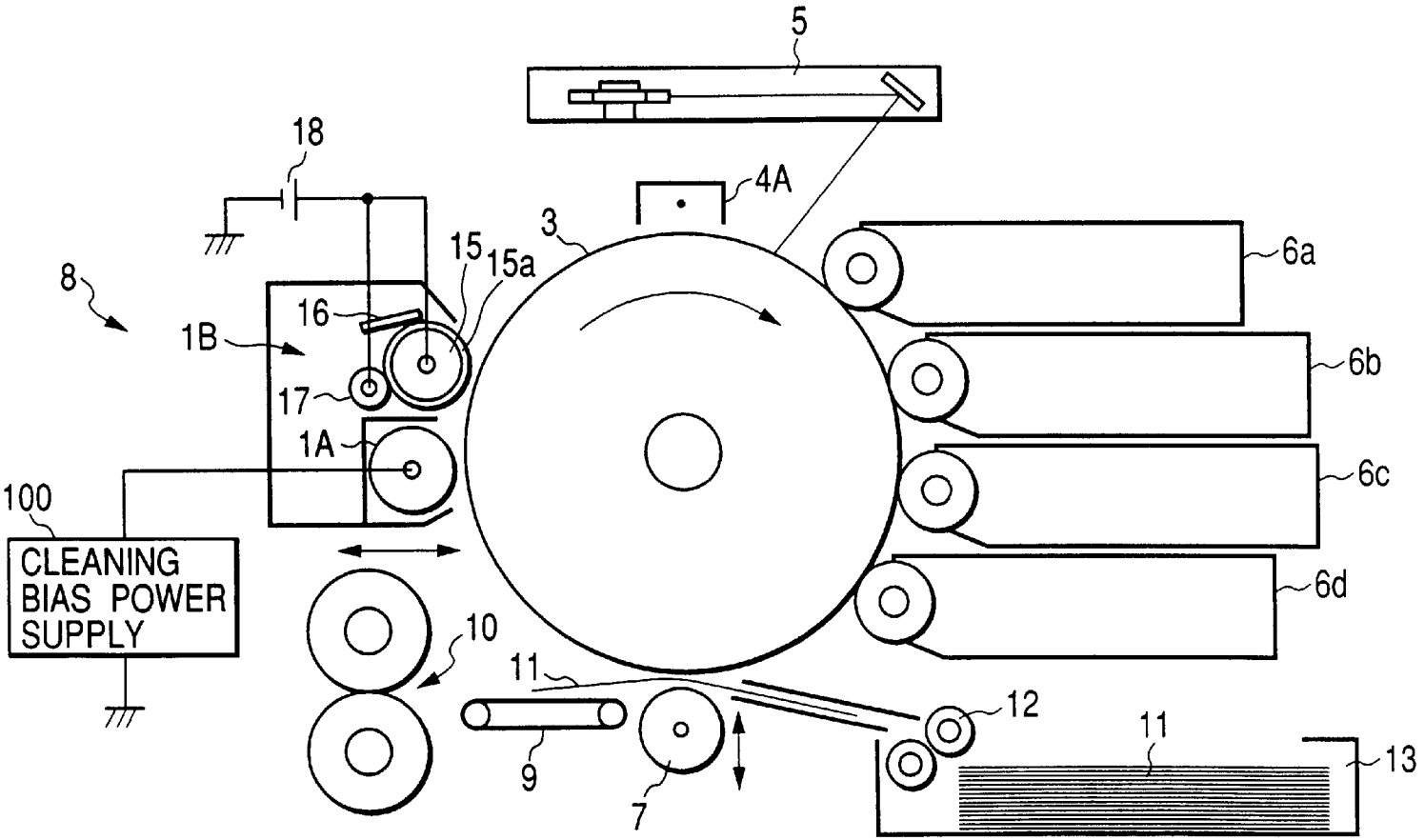
FIG. 4 is a schematic structural diagram of one embodiment of a color image forming apparatus in which the present invention can be applied.
Figure 5:
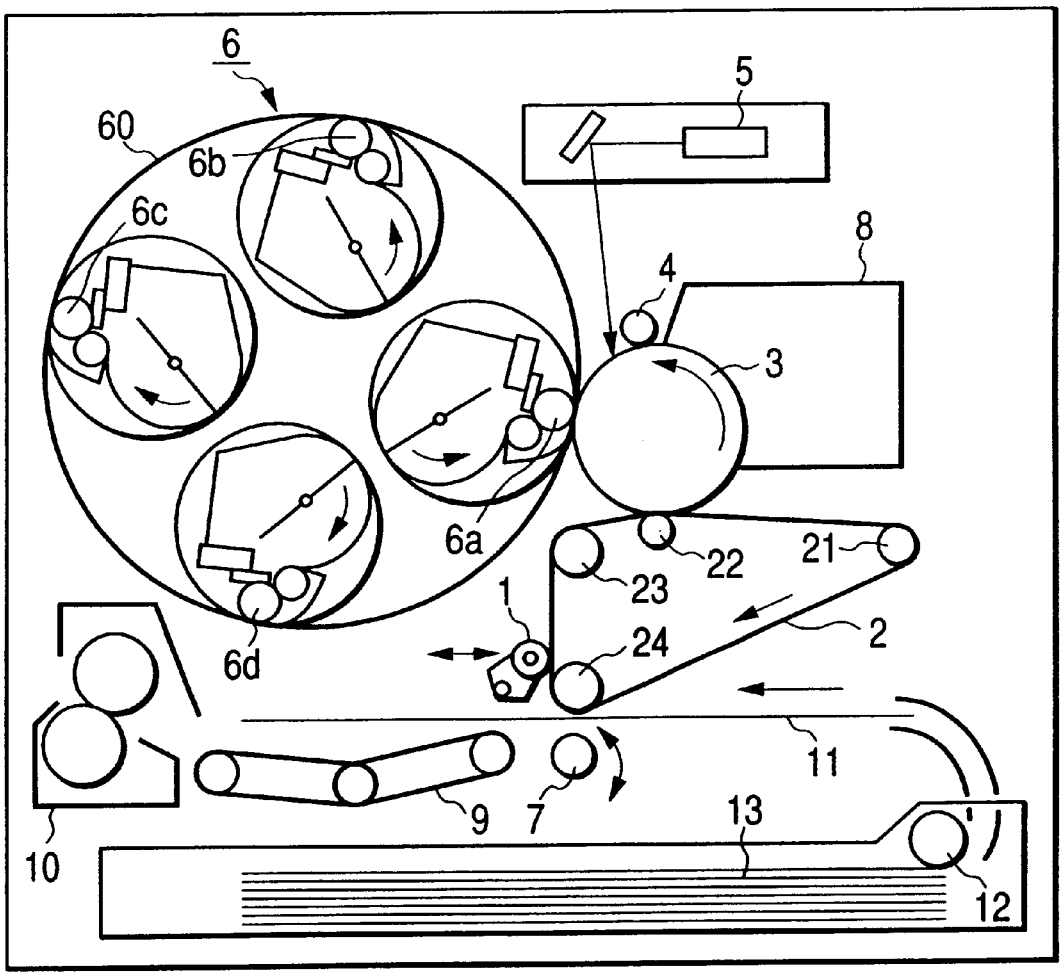
FIG. 5 is a schematic structural diagram of another embodiment of a color image forming apparatus in which the present invention can be applied.

FIG. 4 shows another embodiment of the electrophotographic color image forming apparatus of the present invention.

The color image forming apparatus of the present embodiment is called a multiple developing unit system, and comprises a drum-shaped electrophotographic photosensitive member, which is the image bearing member, or in other words, a photosensitive drum 3. This photosensitive drum 3 is driven in the direction of the arrow by driving means (not shown) and is uniformly charged in the same way, for example negatively, by a primary charger 4A, in this embodiment a corona charger. Next, a laser beam from the exposure device 5 is irradiated on the photosensitive drum 3 and an electrostatic latent image is formed on the photosensitive drum 3. Multiple developing units, in this embodiment four developing units 6*a*, 6*b*, 6*c*, and 6*d*, are disposed opposite the photosensitive drum 3.

In the present embodiment the laser beam is irradiated on the photosensitive drum 3 according to a magenta image pattern from the exposure device 5 and the electrostatic latent image formed on the photosensitive drum 3 is developed into a toner image by the developing unit 6*a* containing magenta toner, for which the regular charging polarity is negative, when the photosensitive drum 3 advances in the direction indicated by the arrow, or in other words the image is visualized developed through reverse development.

By performing the above process for cyan, yellow, and black, a plurality of color toner images are formed on the photosensitive drum 3.

Next, with a designated timing, a transfer material 11 is fed from inside a transfer material cassette 13 by a pick-up roller 12. Simultaneously, a transfer bias is applied to a transfer roller 7 serving as a transfer device, and the toner images are collectively transferred from the photosensitive drum 3 to the transfer material 11. The transfer material 11 is conveyed to a fixing device 10 by a conveying belt 9, and the transferred toner images are fused and fixed to obtain a color image.

The residual toner after transfer on the photosensitive drum 3 after completion of transfer is removed by a cleaning device 8.

During the photosensitive drum cleaning of the color image forming apparatus of the present embodiment, contact and separation of the cleaning device 8 will inevitably arise as a result of sequentially repeating exposure and development on the photosensitive drum.

Conventionally, in order to solve such problems as abutment of the blade and vibration due to abutment during mechanical cleaning using a blade, a contact and separation machine entailing complexity and high costs was used. Further, in order to prevent toner streaks remaining on the abutment portion of the blade arising at separation from effecting the image, it was necessary to use a cleaning assistance means such as a fur brush.

With the present embodiment, the cleaning device 8 is constructed such that it can be contacted with and separated from the photosensitive drum 3, comprising a contact charger 1A as charging means for charging the residual toner after transfer on the photosensitive drum 3, and a collecting device 1B for collecting residual toner after transfer charged by the contact charger 1A.

The contact charger 1A used in the present embodiment is constructed approximately identically to the contact charger 1 used in the intermediate transfer belt cleaning device explained in the above embodiments, is connected to high voltage generating means, in other words the cleaning bias power supply 100, and the bias cutoff method fulfills the same conditions as explained in the above Embodiment 2.

The collecting device 1B has a collecting roller 15, a cleaning blade 16 for scraping the collected residual toner after transfer off the collecting roller 15, and a charge eliminating roller 17 for eliminating the charge on the surface of the collecting roller. The collecting roller 15 and the charge eliminating roller 17 are connected to the positive side of the power supply 18 in this embodiment. The surface of the collecting roller 15 is covered in an insulating film coating 15*a* and has an electric potential of the opposite polarity to the residual toner after transfer and several 100 V larger than the opposite photosensitive drum 3 due to the charge eliminating roller 17.

Accordingly, the method of shutting off the cleaning bias of the present invention as described above is effective in the present embodiment as well, and an uneven electric potential on the surface of the photosensitive drum 3 and toner vomit can be prevented. Further, because the contact charger 1A is constructed as a roller for which the contact and separation mechanism can be simplified, simplification of the apparatus is possible.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an intermediate transfer member;

image forming means for forming a toner image on the intermediate transfer member, wherein the toner image on the intermediate transfer member formed by the image forming means is transferred to a transfer material;

a charging member for charging the intermediate transfer member by contacting the intermediate transfer member, wherein discharge is performed between the charging member and the intermediate transfer member by a voltage in which a direct current voltage and an alternating current voltage are superimposed on one another applied to the charging member when the intermediate transfer member is charged by the charging member; and control means for controlling the voltage applied to the charging member, wherein the control means stops a supply of the alternating current voltage to the charging member after a peak-to-peak voltage of the voltage applied to the charging member is attenuated.

2. The image forming apparatus according to claim 1, wherein the control means controls the direct current voltage and the alternating current voltage independently.

3. The image forming apparatus according to claim 2, wherein the control means controls the peak-to-peak voltage and the alternating current voltage independently.

4. The image forming apparatus according to one of claims 1 to 3, wherein the control means attenuates the peak-to-peak voltage applied to the charging member such that a central value of the peak-to-peak voltage is maintained.

5. The image forming apparatus according to claim 1, wherein the supply of the alternating current voltage to the charging member is stopped after attenuating the peak-to-peak voltage for a predetermined period of time by the control means.

6. The image forming apparatus according to claim 5, wherein the supply of the alternating current voltage to the charging member is stopped after a difference in electric potential between a surface electric potential of the charging member and a surface electric potential of the intermediate transfer member has become smaller than a voltage at commencement of discharge by attenuating the peak-to-peak voltage for the predetermined period of time by the control means.

7. The image forming apparatus according to claim 1, wherein the direct current voltage is zero.

8. The image forming apparatus according to claim 1, wherein the charging member charges residual toner remaining on the intermediate transfer member to a predetermined polarity after the toner image on the intermediate transfer member has been transferred to the transfer material.

9. The image forming apparatus according to claim 8, wherein the charging member charges the residual toner remaining on the intermediate transfer member to an opposite polarity of a regular charging polarity of the toner.

10. The image forming apparatus according to claim 9, wherein a duty ratio of the voltage applied to the charging member is greater than 50%.

11. The image forming apparatus according to one of claims 7 to 10, wherein the image forming means comprises an image bearing member for bearing a toner image and the toner image on the image bearing member is transferred to the intermediate transfer member at a transfer position.

12. The image forming apparatus according to claim 11, wherein the residual toner remaining on the intermediate transfer member charged by the charging member is electrostatically transferred to the image bearing member at the transfer position.

13. The image forming apparatus according to claim 12, wherein an electric field is formed for transferring the toner image on the image bearing member to the intermediate transfer member at the same time as the residual toner remaining on the intermediate transfer member charged by the charging member is transferred to the image bearing member at the transfer position.

14. The image forming apparatus according to claim 1, wherein the charging member charges the intermediate transfer member for at least one revolution of the intermediate transfer member.

15. The image forming apparatus according to claim 1, wherein a volume resistivity of the intermediate transfer member is $10^9$ Ωcm to $10^{16}$ Ωcm.

16. The image forming apparatus according to claim 1, wherein the image forming means comprises an image bearing member for bearing a toner image, a plurality of color toner images are sequentially transferred from the image bearing member to the intermediate transfer member, and the plurality of color toner images on the intermediate transfer member are transferred to a transfer material.

17. The image forming apparatus according to claim 1, wherein the image forming means comprises a plurality of image bearing members for bearing a plurality of color toner images, respectively, the plurality of color toner images on the plurality of image bearing members are sequentially transferred to the intermediate transfer member and the plurality of color toner images on the intermediate transfer member are transferred to the transfer material.

18. An image forming apparatus comprising:

an intermediate transfer member;

image forming means for forming a toner image on the intermediate transfer member, wherein the toner image on the intermediate transfer member formed by the image forming means is transferred to a transfer material;

a charging member for charging the intermediate transfer member and residual toner remaining on the intermediate transfer member after image transfer, wherein the charging member can contact and be separated from the intermediate transfer member and the charging member contacts the intermediate transfer member during charging, wherein discharge is performed between the charging member and the intermediate transfer member by a voltage in which a direct current voltage and an alternating current voltage are superimposed on one another applied to the charging member when the intermediate transfer member is charged by the charging member; and control means for controlling the voltage applied to the charging member, wherein the control means controls a surface electric potential of the charging member when the charging member is separated from the intermediate transfer member.

19. The image forming apparatus according to claim 18, wherein the control means controls such that when the charging member is separated from the intermediate transfer member, a difference in electric potential between the surface electric potential of the charging member and a surface electric potential of the intermediate transfer member is smaller than a voltage at commencement of discharge and the surface electric potential of the charging member is larger than the surface electric potential of the intermediate transfer member and of the same polarity.

20. The image forming apparatus according to claim 18 or 19, wherein the control means attenuates a peak-to-peak voltage of the voltage applied to the charging member and stops a supply of alternating current voltage to the charging member before the charging member is separated from the intermediate transfer member.

21. The image forming apparatus according to claim 20, wherein the control means attenuates the peak-to-peak voltage of the voltage applied to the charging member such that a central value of the peak-to-peak voltage is maintained.

22. The image forming apparatus according to claim 21, wherein the control means controls the direct current voltage and the alternating current voltage independently.

23. The image forming apparatus according to claim 22, wherein the control means controls the peak-to-peak voltage and the alternating current voltage independently.

24. The image forming apparatus according to claim 20, wherein the control means, before the charging member is separated from the intermediate transfer member, stops the supply of the direct current voltage applied to the charging member after the supply of the alternating current voltage to the charging member has been stopped.

25. The image forming apparatus according to claim 20, wherein the control means attenuates the peak-to-peak voltage such that the difference in electric potential between the surface electric potential of the charging member and the surface electric potential of the intermediate transfer member becomes smaller than the voltage at commencement of discharge.

26. The image forming apparatus according to claim 18, wherein the direct current voltage is zero.

27. The image forming apparatus according to claim 18, wherein the charging member charges the residual toner remaining on the intermediate transfer member to a predetermined polarity after the toner image on the intermediate transfer member has been transferred to the transfer material.

28. The image forming apparatus according to claim 27, wherein the charging member charges the residual toner remaining on the intermediate transfer member to an opposite polarity of a regular charging polarity of the toner.

29. The image forming apparatus according to claim 28, wherein a duty ratio of the voltage applied to the charging member is greater than 50%.

30. The image forming apparatus according to one of claims 27 to 29, wherein the image forming means comprises an image bearing member for bearing a toner image and the toner image on the image bearing member is transferred to the intermediate transfer member at a transfer position.

31. The image forming apparatus according to claim 30, wherein the residual toner remaining on the intermediate transfer member charged by the charging member is electrostatically transferred to the image bearing member at the transfer position.

32. The image forming apparatus according to claim 31, wherein an electric field is formed for transferring the toner image on the image bearing member to the intermediate transfer member at the same time as the residual toner on the intermediate transfer member charged by the charging member is transferred to the image bearing member at the transfer position.

33. The image forming apparatus according to claim 18, wherein the charging member charges the intermediate transfer member and the residual toner remaining on the intermediate transfer member for at least one revolution of the intermediate transfer member.

34. The image forming apparatus according to claim 18, wherein a volume resistivity of the intermediate transfer member is $10^9$ Ωcm to $10^{16}$ Ωcm.

35. The image forming apparatus according to claim 18, wherein the image forming means comprises an image bearing member for bearing a toner image, a plurality of color toner images are sequentially transferred from the image bearing member to the intermediate transfer member, and the plurality of color toner images on the intermediate transfer member are transferred to the transfer material.

36. The image forming apparatus according to claim 18, wherein the image forming means comprises a plurality of image bearing members for bearing a plurality of color toner images, respectively, the plurality of color toner images on the plurality of image bearing members are sequentially transferred to the intermediate transfer member and the plurality of color toner images on the intermediate transfer member are transferred to the transfer material.

37. An image forming apparatus comprising:

an image bearing member;

image forming means for forming a toner image on the image bearing member, wherein the toner image on the image bearing member formed by the image forming means is transferred to a transfer material;

a charging member for charging the image bearing member by contacting the image bearing member, wherein discharge is performed between the charging member and the image bearing member by a voltage in which a direct current voltage and an alternating current voltage are superimposed on one another applied to the charging member when the image bearing member is charged by the charging member; and control means for controlling the voltage applied to the charging member, wherein the control means stops a supply of an alternating current voltage to the charging member after attenuating a peak-to-peak voltage of the voltage applied to the charging member.

38. The image forming apparatus according to claim 37, wherein the control means controls the direct current voltage and the alternating current voltage independently.

39. The image forming apparatus according to claim 38, wherein the control means controls the peak-to-peak voltage and the alternating current voltage independently.

40. The image forming apparatus according to one of claims 37 to 39, wherein the control means attenuates the peak-to-peak voltage applied to the charging member such that a central value of the peak-to-peak voltage is maintained.

41. The image forming apparatus according to claim 37, wherein a supply of the alternating current voltage applied to the charging member is stopped after attenuating the peak-to-peak voltage for a predetermined period of time with the control means.

42. The image forming apparatus according to claim 41, wherein the control means stops the supply of the alternating current voltage to the charging member after a difference in electric potential between a surface electric potential of the charging member and a surface electric potential of the image bearing member becomes smaller than a voltage at commencement of discharge by attenuating the peak-to-peak voltage for the predetermined time by the control means.

43. The image forming apparatus according to claim 37, wherein the direct current voltage is zero.

44. The image forming apparatus according to claim 37, wherein the charging member charges the residual toner remaining on the image bearing member to a predetermined polarity after the toner image on the image bearing member has been transferred to the transfer material.

45. The image forming apparatus according to claim 44, wherein the charging member charges the residual toner remaining on the image bearing member to an opposite polarity of a regular charging polarity of the toner.

46. The image forming apparatus according to claim 45, wherein a duty ratio of the voltage applied to the charging member is greater than 50%.

47. The image forming apparatus according to one of claims 44 to 46, further comprising a collecting member for electrostatically collecting the residual toner remaining on the image bearing member charged by the charging member.

48. The image forming apparatus according to claim 47, wherein the image forming means comprises developing means for developing a latent image on the image bearing member as a toner image.

49. The image forming apparatus according to claim 37, wherein the charging member charges the image bearing member for at least a period during which the image bearing member makes one revolution.

50. The image forming apparatus according to claim 37, wherein the image forming means sequentially forms a plurality of color toner images on the image bearing member and the plurality of color toner images on the image bearing member are transferred to the transfer material.

51. An image forming apparatus comprising:

an image bearing member;

image forming means for forming a toner image on the image bearing member, wherein the toner image on the image bearing member formed by the image forming means is transferred to a transfer material;

a charging member for charging the image bearing member and residual toner remaining on the image bearing member after image transfer, wherein the charging member can contact and be separated from the image bearing member and contacts the image bearing member during charging, wherein discharge is performed between the charging member and the image bearing member by a voltage in which a direct current voltage and an alternating current voltage are superimposed on one another applied to the charging member when the image bearing member is charged by the charging member; and control means for controlling the voltage applied to the charging member, wherein the control means controls a surface electric potential of the charging member when the charging member is separated from the image bearing member.

52. The image forming apparatus according to claim 51, wherein the control means controls such that when the charging member is separated from the image bearing member, a difference in electric potential between a surface electric potential of the charging member and a surface electric potential of the image bearing member is smaller than a voltage at commencement of discharge and the surface electric potential of the charging member is greater than the surface electric potential of the image bearing member and of the same polarity.

53. The image forming apparatus according to claim 51 or 52, wherein the control means attenuates a peak-to-peak voltage applied to the charging member and stops a supply of the alternating current voltage to the charging member before the charging member is separated from the image bearing member.

54. The image forming apparatus according to claim 53, wherein the control means attenuates the peak-to-peak voltage applied to the charging member such that a central value of the peak-to-peak voltage is maintained.

55. The image forming apparatus according to claim 54, wherein the control means controls the direct current voltage and the alternating current voltage independently.

56. The image forming apparatus according to claim 55, wherein the control means controls the peak-to-peak voltage and the alternating current voltage independently.

57. The image forming apparatus according to claim 53, wherein the control means stops a supply of the direct current voltage applied to the charging member after stopping the supply of the alternating current voltage to the charging member and before the charging member is separated from the image bearing member.

58. The image forming apparatus according to claim 53, wherein the control means attenuates the peak-to-peak voltage such that a difference in electric potential between a surface electric potential of the charging member and a surface electric potential of the image bearing member is smaller than a voltage at commencement of discharge.

59. The image forming apparatus according to claim 51, wherein the direct current voltage is zero.

60. The image forming apparatus according to claim 51, wherein the charging member charges the residual toner remaining on the image bearing member to a predetermined polarity after the toner image on the image bearing member is transferred to the transfer material.

61. The image forming apparatus according to claim 60, wherein the charging member charges the residual toner remaining on the image bearing member to an opposite polarity of a regular charging polarity of the toner.

62. The image forming apparatus according to claim 61, wherein a duty ratio of the voltage applied to the charging member is greater than 50%.

63. The image forming apparatus according to one of claims 60 to 62, further comprising a collecting member for electrostatically collecting the residual toner remaining on the image bearing member charged by the charging member.

64. The image forming apparatus according to claim 63, wherein the image forming means comprises developing means for developing a latent image on the image bearing member as a toner image.

65. The image forming apparatus according to claim 51, wherein the charging member charges the image bearing member for at least a period of time during which the image bearing member rotates through one revolution.

66. The image forming apparatus according to claim 51, wherein the image forming means sequentially forms a plurality of color toner images on the image bearing member and the plurality of color toner images on the image bearing member are transferred to the transfer material.

* * * * *

UNITED STATES PATENT AND TRADEMARK OFFICE

CERTIFICATE OF CORRECTION

PATENT NO. : 6,167,215
DATED : December 26, 2000
INVENTOR(S) : Toshiaki Miyashiro, et al.

It is certified that error appears in the above-identified patent and that said Letters Patent is hereby corrected as shown below:

Column 1,
Line 35, "developed" should read -- (developed) --.

Column 9,
Line 66, 1kvpp," should read -- 1 kVpp, --.

Column 11,
Line 7, "developed" should read -- (developed) --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*